United States Patent [19]

Berlincourt

[11] Patent Number: 4,863,372

[45] Date of Patent: Sep. 5, 1989

[54] GAS IGNITION APPARATUS

[75] Inventor: Don A. Berlincourt, Chagrin Falls, Ohio

[73] Assignee: Channel Products, Inc., Chesterland, Ohio

[21] Appl. No.: 203,886

[22] Filed: Jun. 8, 1988

[51] Int. Cl.[4] ..... F23N 5/00

[52] U.S. Cl. ..... 431/66; 431/73

[58] Field of Search ..... 431/66, 67, 72, 73

[56] References Cited

U.S. PATENT DOCUMENTS

| | | | |
|---|---|---|---|
| 3,748,083 | 7/1973 | Finger | 431/66 |
| 3,759,654 | 9/1973 | Clifford | 431/66 |
| 3,829,739 | 8/1974 | Andersen et al. | 431/66 X |
| 3,871,814 | 3/1975 | Das et al. | 431/66 |
| 3,975,136 | 8/1976 | Baysinger et al. | 431/66 X |
| 4,033,711 | 7/1977 | Christian et al. | 431/66 |
| 4,402,663 | 9/1983 | Romanelli et al. | 431/66 |

*Primary Examiner*—Margaret A. Focarino

*Attorney, Agent, or Firm*—James A. Hudak

[57] ABSTRACT

A spark ignition system for a heater-type ignitor is disclosed. Current through the ignitor is transformed into a voltage which is utilized to operate a timing circuit which, in turn, causes operation of a valve permitting the flow of fuel to a burner. Operation of the valve can occur only after the expiration of a predetermined period of time and the presence of a predetermined minimum voltage to the ignitor thus ensuring that the ignitor has reached the ignition temperature of the fuel before the valve is permitted to open.

12 Claims, 1 Drawing Sheet

GAS IGNITION APPARATUS

TECHNICAL FIELD

The present invention relates to apparatus for igniting gas flowing from a burner and more particularly to apparatus which ensures that a heater-type ignition device has reached ignition temperature before gas is allowed to flow from the burner.

BACKGROUND ART

In many gas burner applications it is desirable or necessary to ensure that the ignition device is fully operable before gas is allowed to flow within the system. In essence, the gas ignition device is "proven" prior to gas being allowed to flow through the system. Various approaches have been taken in order to "prove" the ignition device prior to gas flow. For example, one approach requires a visual recognition or detection of the spark from a sparking ignition device prior to allowing gas flow. It has been found that the detection of such a spark is very difficult in the presence of ambient light, and the detection means must therefore be shielded from external light. Another approach is based on the acoustic recognition, rather than the visual recognition, of the spark. Here again, it has been found that it is very difficult to shield against external noise and the detection source must be capable of detecting the particular sound of the spark. Still another approach is based on proving the existence of energy pulses in the spark generating circuit. This approach has inherent problems since it is possible to have such pulses without an actual spark. Still another approach is based upon measuring the electrical resistance of a heater-type ignition device and comparing same to a reference resistance. In this case, the gas valve is not allowed to open until the resistance of the ignition device approximates that of the reference resistance. It has been found that this reference comparing technique requires complex circuitry which is subject to failure and has inherent problems caused by aging of the reference resistance and/or other circuit components. Thus, each of the prior art approaches of ensuring that the ignition device is fully operable before gas is allowed to flow in the system has some inherent problems.

Because of the foregoing limitations and problems associated with the prior art approaches of ensuring that ignition device is fully operable before the gas valve is allowed to open, it has become desirable to develop a simple, fail safe ignition system which prevents gas flow to the burner until the heater-type ignition device has reached ignition temperature.

SUMMARY OF THE INVENTION

The present invention solves the problems associated with the prior art devices and other problems by placing the heater-type ignitor in series with the primary coil of a transformer. The combination of the primary coil of the transformer and the heater is provided with electrical power from an AC power source which will usually be 117 volts, but is not limited to a 117 volt AC source. The secondary coil of the transformer is connected to a half-wave rectifier and a filter capacitor which produces a DC voltage level having moderate ripple. This DC voltage level is then clamped by a zener diode producing a relatively constant DC output voltage which is applied to a gas valve starting circuit causing negligible loading of the DC voltage. The gas valve starting circuit opens the gas valve only after it has received power for a predetermined period of time. After the expiration of the predetermined period of time, the starting circuit operates a relay which, in turn, operates the gas valve permitting gas to flow within the system. The relay actuating circuit is adjusted so that no gas can flow unless the line voltage at that time, i.e., end of the heating cycle, is at least a certain reference level, e.g., 95 volts for a 117 volt AC power source. In this manner, voltage must be applied to the heater for the predetermined period of time and the voltage must be sufficient before the gas valve is allowed to operate, thus ensuring that the heater has reached ignition temperature before actuation of the gas valve. In another embodiment of the system, the actuating circuit for the relay which transmits power to the heater is also adjusted so that it is not actuated unless the line voltage is at least a certain reference level, e.g., 95 volts for a 117 volt AC power source, thus ensuring sufficient voltage to the heater at the start of the heating cycle.

DESCRIPTION OF THE PREFERRED EMBODIMENT

Figure 1:
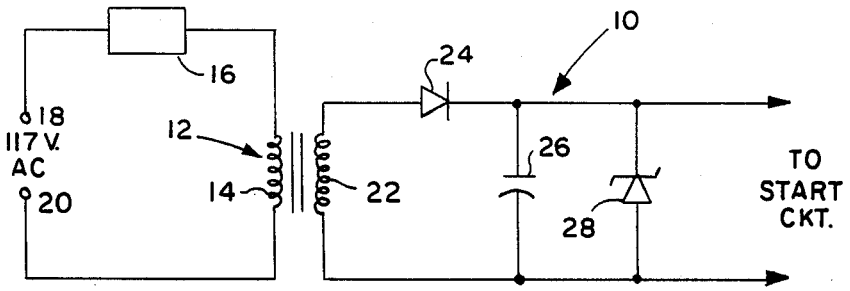
FIG. 1 is a schematic drawing of the circuit utilized by the present invention.

Referring now to the drawings where the illustrations are for the purpose of describing the preferred embodiment of the present invention and are not intended to limit the invention hereto, FIG. 1 is a schematic diagram of a power circuit 10 for an ignitor. As such, the circuit 10 includes a voltage to current transformer, shown generally by the numeral 12, having its primary coil 14 connected in series with a heater 16, such as a silicon carbide ignitor. The combination of the primary coil 14 of the transformer 12 and the heater 16 is provided power by a 117 volt AC source connected across the input terminals 18 and 20. The secondary coil 22 of the transformer 12 is connected to a diode 24 and a capacitor 26. A zener diode 28 is connected in parallel across the capacitor 26, and the output of the circuit 10 is taken across the terminals of the zener diode 28. The output of this circuit 10 is connected to a start circuit of a complete ignition system which might take one of many different forms, depending upon the desired application. The start circuit must, however, draw low current, i.e., less than a few milliamperes.

The primary coil 14 of the transformer 12 consists of a few turns of wire having a cross-section sufficient to carry about 5 amperes maximum current. For example, in one embodiment the total resistance of the primary coil 14 is approximately 0.03 ohms and the inductive reactance is on the order of 0.1 ohms at 60 Hz resulting in a voltage drop of approximately 0.5 volts across this coil 14. The secondary coil 22 of the transformer 12 consists of approximately 2000 turns of fine wire. Neglecting saturation effects, the voltage step-up ratio of the transformer 12 would result in a voltage across the secondary coil 22 of approximately 100 volts. Saturation reduces this voltage to approximately 50 volts peak.

Figure 2:
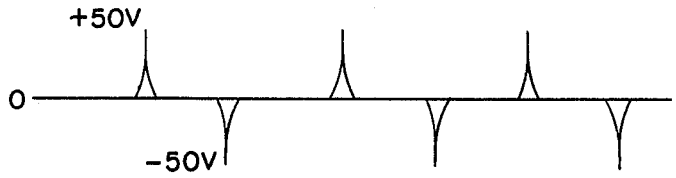
FIG. 2 is a drawing of the wave shape produced by the half-wave rectifier connected to the transformer secondary coil of the present invention.

Operationally, when ignition of the gas flow through a gas valve is required, the aforementioned current flow of approximately 2 to 5 amperes occurs through the primary coil 14 of the transformer 12 and the heater 16. This current flow results in a voltage drop of approximately 500 millivolts across the primary coil 14 of the transformer 12 causing an AC voltage of approximately 50 volts peak to be produced across the secondary coil 22. This voltage has a positive and negative spiked configuration as shown in FIG. 2. When this voltage is applied to the diode 24, which acts as a half-wave rectifier, all negative voltage spikes are eliminated, and the capacitor 26 acts as a smoothing capacitor. The resulting DC voltage level has a relatively low ripple factor. The zener diode 28 acts as a clamp preventing this DC voltage level from rising above a predetermined value (usually about 25 volts). The output of this circuit 10 is applied to a start circuit which may take one of many different forms and is operable after it has received power for a predetermined time, i.e., after the expiration of the predetermined period of time, the start circuit actuates a relay which, in turn, operates the gas valve permitting gas to flow therethrough. The resistance in series with this relay can be adjusted so that the relay operates only if the voltage across the heater 16 is at least approximately 90 to 95 volts AC RMS. In this manner, sufficient voltage must be applied to the heater 16 for the predetermined period of time in order to heat same, thus preventing the gas valve from opening unless the heater 16 has reached ignition temperature. Thus, current through the heater 16 is effectively operating the timing circuit which, in turn, operates the gas valve through the relay. In summary, the circuit 10 is fail safe in that it requires the application of sufficient voltage to the heater 16 for a predetermined period of time, resulting in sufficient current flow through the heater to cause it to reach ignition temperature prior to the opening of the gas valve. An additional check on voltage supplied to the heater uses a resistance connected in series with the relay which provides power to the heater. This resistance is adjusted so that the heater relay operates only if the voltage to the heater is at least approximately 90 to 95 volts AC RMS.

This circuit 10 overcomes the aforementioned problems associated with the prior art. For example, it does not rely upon the visual detection of a spark which is extremely difficult in the presence of ambient light. Furthermore, it does not depend upon the acoustic recognition of a spark which is difficult to achieve because of external noise and the problems associated with recognizing a peculiar sound associated with the spark. In addition, it does not rely upon proving the existence of energy pulses in the spark generating circuit which are possible without an actual spark. And lastly, it does not require measuring the electrical resistance of a heater-type ignitor which has inherent inaccuracies due to the effects of aging on the circuit components and which requires relatively complex circuitry for fail safe operation.

Figure 3:
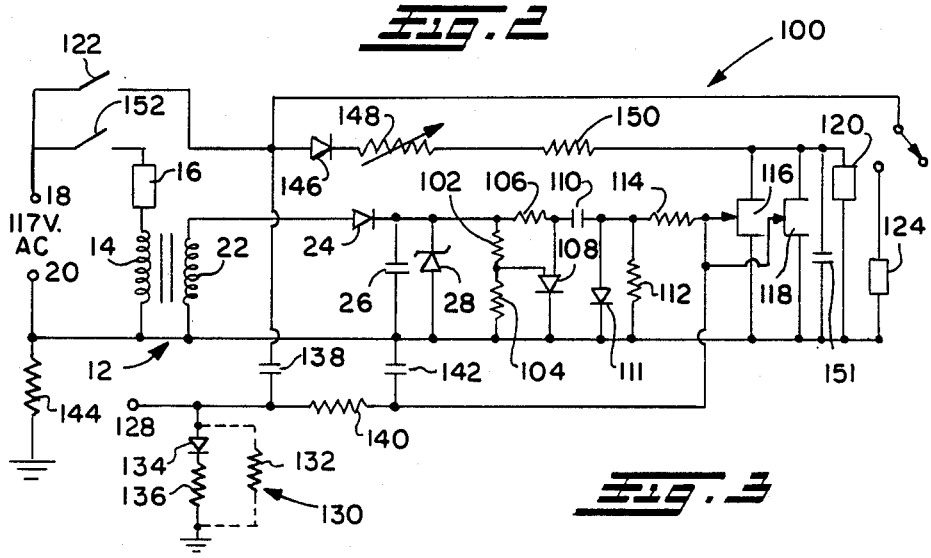
FIG. 3 is a schematic drawing of the circuit utilized by the present invention in conjunction with a start circuit, a flame rectification circuit and a gas solenoid valve.

Referring now to FIG. 3, the present invention is illustrated schematically in an electrical circuit 100 which incorporates a start circuit, a gas solenoid valve and a flame rectification circuit. Those components which are similar to the components in FIG. 1 have like reference numerals and will not be discussed further. The timing circuit includes resistors 102, 104, and 106; programmable unijunction transistor 108; capacitor 110; diode 111; and resistors 112 and 114 arranged and interconnected as shown. The output from resistor 114 is connected to the gates of field-effect transistors 116 and 118, and a relay coil 120 is connected in parallel with the transistors 116 and 118. The common contact associated with the relay coil 120 is connected to the input terminal 18 via a thermostat 122 and, upon actuation of the relay coil 120, connects the 117 volt AC source to a gas solenoid valve 124.

The input terminal 128 is connected to a metallic probe or flame electrode which is immersed in the burner flame. The equivalent electrical circuit of the flame is shown generally by the numeral 130 and is comprised of a resistor 132 connected in parallel with the series combination of a diode 134 and another resistor 136. A capacitor 138 is connected to the AC input terminal 18 via thermostat 122 and to the input terminal 128 of the probe. The input terminal 128 is also connected to the gates of the field effect transistors 116 and 118 via a resistor 140. In addition, a capacitor 142 is connected to the common side of the secondary coil 22 of the transformer 12 and to the gates of the field-effect transistors 116 and 118. The transformer common and the neutral side of the AC line are connected to chassis ground through a resistor 144 having a value of approximately one megohm.

Half-wave rectified DC power is provided to the relay coil 120 via a diode 146 and resistors 148 and 150. Resistor 148 can be varied to adjust the resulting voltage applied to the relay coil 120. A ripple smoothing capacitor 151 is connected to the relay coil 120 and to the transformer common.

Figure 4:
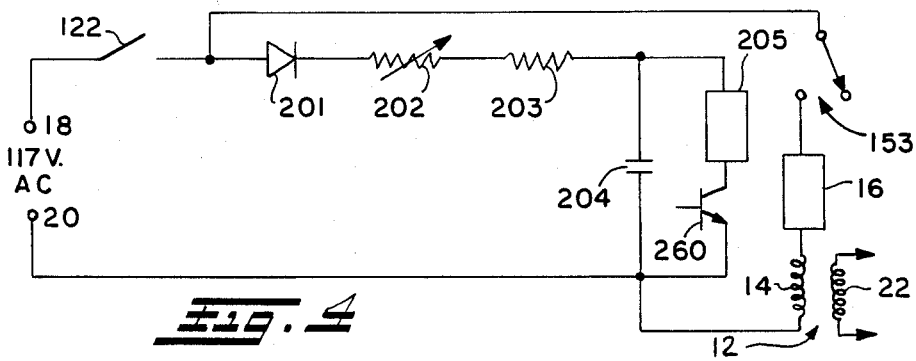
FIG. 4 is a schematic drawing of the circuit used to actuate the heater-type ignition device incorporating an adjustment to prevent power from being supplied to the heater unless the power source voltage exceeds a reference level.

The electrical circuit 100 operates in the following manner. When the thermostat 122 "calls" for heat, its contacts close which results in the closing of contact 152 through another relay which is shown in FIG. 4. The closing of contact 152 causes a current of approximately 2 to 5 amperes to flow through the primary coil 14 of the transformer 12 and the heater 16. This current flow results in an AC voltage of approximately 50 volts peak being produced across the secondary coil 22 of the transformer 12. The diode 24 acts as a half-wave rectifier and capacitor 26 acts as a smoothing capacitor resulting in a DC voltage level having a relatively low ripple factor. The zener diode 28 prevents this DC voltage level from rising above a predetermined value, typically about 25 volts. This DC voltage is applied to the timing circuit. The resistors 102 and 104 act as a voltage divider to bias the gate of the programmable unijunction transistor 108. Typical resistance values for the resistors 102 and 104 are 2 megohms and 15 megohms, respectively, which "set" the gate of the transistor 108. Thus, the transistor 108 remains unactuated until the capacitor 110 is nearly fully charged through the resistor 106 and diode 111. The values for the capacitor 110 and the resistor 106 may be chosen so that the charging time for the capacitor 110 is relatively long. When the voltage at the anode of the transistor 108 exceeds its gate voltage, the transistor 108 turns "on", effectively grounding the positive plate of the capacitor 110, i.e., the plate connected to the anode of the transistor 108. This grounding action causes the capacitor 110 to apply a sufficiently negative voltage to the gates of the field effect transistors 116 and 118 through the resistor 114, turning these transistors "off", i.e., these transistors usually act as a short circuit, but when there is a sufficient negative voltage applied to their respective gates, they become essentially an open circuit. The extinguishing of these transistors 116 and 118 causes the relay coil 120 to become actuated which, in turn, causes the gas solenoid valve 124 to become actuated. It should be noted that relay coil 120 will not become actuated unless sufficient voltage is applied thereto and resistor 148 is adjusted so that relay coil 120 will not become actuated unless the voltage across the heater 16 is in excess of a set value, for instance, 90 to 95 volts AC, in this example. Thus, sufficient voltage must be applied to the heater 16 for a predetermined period of time ensuring that the heater 16 has reached ignition temperature before the gas solenoid valve 124 is allowed to open.

As soon as transistor 108 turns "on", the capacitor 110 begins to discharge through the transistor 108 and the resistor 112. The discharge time may take approximately 5 seconds, for instance, to reduce the voltage at the gates of the field-effect transistors 116 and 118 to a level at which the transistors 116, 118 may again turn "on". During this time the gas continues to flow to the burner. If the gas is not ignited by the heater during this 5 second ignition period, then the field effect transistors 116 and 118 again turn "on" which causes the deactuation of the relay coil 120 and gas solenoid valve 124. This process is known as a five second trial for ignition period and can be set within wide limits by using different values for capacitor 110 and resistor 112.

If the gas is ignited during the foregoing 5 second ignition period, the flame acts as a low quality diode, shown schematically as the diode 134 and resistors 132 and 136, from input terminal 128 to ground potential. This action as a diode causes the capacitor 138 to be charged so that its bottom plate is negative with respect to its top plate. This charging action also causes the capacitor 142 to be charged through the resistor 140 so that its bottom plate is also negative with respect to its top plate which causes the field-effect transistors 116 and 118 to be turned "off". This charging action ensures that the field-effect transistors 116 and 118 remain turned "off", when there is a flame, even though capacitor 110 becomes discharged. Thus, the gas solenoid valve 124 remains actuated permitting continuing gas flow to the burner. The electrical circuit 100 remains in this state as long as the thermostat 122 is "calling" for heat and there is a flame. If the contacts associated with the thermostat 122 open, upon their reclosure the foregoing ignition sequence is recommenced.

Once a flame has been established, the heater 16 is turned off by means of a circuit (not shown). It should be noted that in some installations the heater is then used as a flame probe. In any event, if there is an interruption in the gas flow to the burner or if the flame is extinguished due to a gust of wind, the voltage at capacitor 142 quickly discharges through resistors 114 and 112 and the relay 120 becomes deactuated closing the gas solenoid valve 124. The foregoing sequence reactuates the heater 16 through contact 152 and the entire sequence is reinitiated, i.e., current through the heater 16 again flows through the primary winding 14 of the transformer 22. This provides power to the gas valve timing circuit as upon initial start-up conditions. The circuit for reactuation of the heater is not shown herein.

Referring now to FIG. 4 which is a partial schematic of an actuation circuit for the heater 16, when the thermostat 122 "calls" for heat, the base of transistor 260 receives a signal through a circuit (not shown) and actuates relay 205 connecting the 117 volt AC power source to the heater 16. The contacts associated with relay 205 are shown as contact 152 in FIG. 3 and normally open contact 153 in FIG. 4. As an additional requirement for sufficient voltage to provide sufficient ignition temperature at the heater, resistor 202 may be adjusted so that relay 205 is actuated only if the power source voltage is sufficient, i.e., at least approximately 90 to 95 volts AC RMS, for this example. This adjustment ensures sufficient voltage at the start of the heating cycle, and the adjustment of resistor 148 in FIG. 3 ensures sufficient voltage at the end of the heating cycle.

Depending upon the specific circuit design, transistor 260 is turned off during the programmed trial period or upon flame establishment. If the flame is lost due to an interruption in gas flow or a gust of wind, transistor 260 is turned on again initiating another timing cycle identical to that which occurred upon thermostat closure. This circuit detail is not shown herein.

The foregoing apparatus can be applied to all heaters operated from an AC power source. The heater may operate from 24, 117 or 240 volts AC. The thermostat may operate at a different voltage from the heater. For example, the thermostat may be operable at 24 volts AC and the heater at 117 volts AC. In this case, the thermostat 122, as shown in FIG. 3, would simply be connected to the ungrounded side of a 24 volt AC power source in order to make it operable at this latter voltage.

Certain modification and improvements will occur to those skilled in the art upon reading the foregoing. It should be understood that all such modifications and improvements have been deleted herein for the sake of conciseness and readability, but are properly within the scope of the following claims.

I claim:

1. Apparatus for controlling the operation of a valve which regulates the flow of fuel to a burner comprising:

means for igniting the flow of fuel emanating from the burner, said igniting means being responsive to the flow of electrical current therethrough;

timing means operable upon the expiration of a predetermined period of time if electrical current is flowing through said igniting means upon the expiration of said pre-determined period of time; and means for transforming the flow of electrical current through said igniting means into a voltage sufficient to cause said timing means to operate causing the actuation of the valve permitting the flow of fuel to the burner, said transforming means being electrically connected to said igniting means and to said timing means.

2. The apparatus as defined in claim 1 further including first switching means electrically connected to said timing means, operation of said timing means causing the actuation of said first switching means and the valve permitting the flow of fuel to the burner.

3. The apparatus as defined in claim 2 wherein said first switching means is operable in response to the application of a first pre-determined minimum voltage thereto.

4. The apparatus as defined in claim 1 further including second switching means electrically connected to said igniting means, operation of said second switching means permitting the flow of electrical current to pass through said igniting means causing the heating of said igniting means to the ignition temperature of the fuel.

5. The apparatus as defined in claim 4 wherein said second switching means is operable in response to the application of a second pre-determined minimum voltage thereto.

6. Apparatus for controlling the operation of a valve which regulates the flow of fuel to a burner comprising:

means for igniting the flow of fuel emanating from the burner, said igniting means being responsive to the flow of electrical current therethrough;

timing means operable upon the expiration of a predetermined period of time if electrical current is flowing through said igniting means upon the expiration of said pre-determined period of time;

first switching means electrically connected to said timing means, operation of said timing means causing the actuation of said first switching means and the valve permitting the flow of fuel to the burner; and means for transforming the flow of electrical current through said igniting means into a voltage sufficient to cause said timing means to actuate said first switching means and the valve permitting the flow of fuel to the burner, said transforming means being electrically connected to said igniting means and to said timing means.

7. The apparatus as defined in claim 6 wherein said first switching means is operable in response to the application of a first pre-determined minimum voltage thereto.

8. The apparatus as defined in claim 6 further including second switching means electrically connected to said igniting means, operation of said second switching means permitting the flow of electrical current to pass through said igniting means causing the heating of said igniting means to the ignition temperature of the fuel.

9. The apparatus as defined in claim 8 wherein said second switching means is operable in response to the application of a second pre-determined minimum voltage thereto.

10. Apparatus for controlling the operation of a valve which regulates the flow of fuel to a burner comprising:

means for igniting the flow of fuel emanating from the burner, said igniting means being responsive to the flow of electrical current therethrough;

timing means operable upon the expiration of a predetermined period of time if electrical current is flowing through said igniting means upon the expiration of said pre-determined period of time;

first switching means electrically connected to said timing means, operation of said timing means causing the actuation of said first switching means and the valve permitting the flow of fuel to the burner;

means for transforming the flow of electrical current through said igniting means into a voltage sufficient to cause said timing means to actuate said first switching means and the valve permitting the flow of fuel to the burner, said transforming means being electrically connected to said igniting means and to said timing means; and second switching means electrically connected to said igniting means, operation of said second switching means permitting the flow of electrical current to pass through said igniting means causing the heating of said igniting means to the ignition temperature of the fuel.

11. The apparatus as defined in claim 10 wherein said first switching means is operable in response to the application of a first pre-determined minimum voltage thereto.

12. The apparatus as defined in claim 10 wherein said second switching means is operable in response to the application of a second pre-determined minimum voltage thereto.

* * * * *